United States Patent [19]

Laprade et al.

[11] 4,022,175

[45] May 10, 1977

[54] CARBURETTOR FOR AN INTERNAL COMBUSTION ENGINE

[75] Inventors: Bernard Laprade; Xavier Laprade, both of Arudy; Pierre Gelé, Laloubere, all of France

[73] Assignees: Les Usines Laprade; Societe Nationale des Petroles d'Aquitaine, France

[22] Filed: Jan. 15, 1975

[21] Appl. No.: 541,252

[30] Foreign Application Priority Data

Jan. 21, 1974 France ..... 74.01885

[52] U.S. Cl. ..... 123/140 MC; 123/32 EA; 123/139 AW; 123/119 A

[51] Int. Cl.[2] ..... F02B 3/00; F02B 75/10

[58] Field of Search ..... 123/32 EA, 140 MC, 127, 123/119 A, 119 R, 139 AW; 60/285, 276

[56] References Cited

UNITED STATES PATENTS

| | | | |
|---|---|---|---|
| 3,721,428 | 3/1973 | Gelé | 123/119 R |
| 3,738,341 | 6/1973 | Loos | 123/140 MC |
| 3,759,232 | 9/1973 | Wahl | 123/32 EA |
| 3,827,237 | 8/1974 | Linder | 123/32 EA |
| 3,874,171 | 4/1975 | Schmidt | 60/285 |
| 3,918,257 | 11/1975 | Hirose | 60/285 |

*Primary Examiner*—Ronald H. Lazarus
*Attorney, Agent, or Firm*—James E. Bryan

[57] ABSTRACT

A carburettor for an internal combustion engine including a main duct and an auxiliary duct which receive air from a valved inlet, a main valve in each of the ducts for controlling flow through the ducts. Fuel is introduced into the auxiliary duct upstream of the main valve therein but downstream of an auxiliary valve in the auxiliary duct which is used to control the fuel to air ratio of the fuel/air mixture produced by the carburettor. The auxiliary valve is controlled in accordance with engine temperature, pressure drop across air filter, degree of dilution of recycled exhaust gases, degree of combustion of exhaust gases, temperature of air entering the engine, or atmospheric pressure.

4 Claims, 3 Drawing Figures

CARBURETTOR FOR AN INTERNAL COMBUSTION ENGINE

FIELD OF INVENTION

This invention relates to a carburettor for an internal combustion engine.

BACKGROUND TO THE INVENTION

It is known to provide a carburettor in which air from an inlet is arranged to pass through both a main duct and an auxiliary duct into an inlet manifold for an internal combustion engine. Fuel is introduced into the auxiliary duct through a tube and is mixed with the air flowing therethrough, the resulting fuel/air mixture being mixed with the air from the main duct in the inlet manifold, and the mixture then being valved into the cylinders of the engine. A carburettor of this kind is described in our U.S. Pat. No. 3,721,428 in which a main butterfly valve is provided in each of the ducts, a further butterfly valve is provided in the inlet, and an auxiliary butterfly valve is provided in the auxiliary duct upstream of the fuel injection tube. We have found that the auxiliary butterfly valve can be used for controlling the fuel/air mixture, and in our aforementioned specification we described an arrangement for manually setting the auxiliary butterfly valve to control the mixture at idling engine speeds, and for automatically changing the setting of the valve with changing engine speed. However, in view of the present stringent requirements for fuel economy and pollution control, we have devised an improved carburettor in which the fuel/air mixture for the engine is controlled automatically to maintain optimum performance of the carburettor.

We have found the following operating parameters of an internal combustion engine each provide an indication of the richness of the carburetted mixture required to be introduced into the engine:

1. Engine temperature

A low engine temperature necessitates enrichment of the fuel/air mixture applied to the engine to compensate for reduced evaporation of the petrol inside the cylinders of the engine.

2. Pressure drop across air inlet filter to carburettor

Any increase in the pressure drop across the filter enriches the proportion of fuel in the fuel/air mixture produced by the carburettor.

3. Degree of dilution of the mixture by exhaust gases

It is known that one of the means of lowering the emission of oxides of nitrogen in the exhaust gases is to recirculate exhaust gases to the intake of the engine, and it is known to reintroduce the gases into the carburettor at a point at which the pressure remains substantially constant in order to obtain a substantially constant proportion of exhaust gases in the gas mixture introduced into the engine whatever the load and speed of the engine.

This introduction of exhaust gases alters the rate of atomization of fuel in the carburettor and hence alters the required needle setting of the carburettor.

4. Content of CO or $O_2$ in engine exhaust gases

It is known that to reduce pollution it is preferred to maintain the richness of the mixture from a carburettor, in the vicinity of stoichiometry in order to limit emission of CO and hydrocarbons. A means of detection of stoichiometry by the employment of a zirconium oxide-base oxygen-probe is known.

5. Air temperature and atmospheric pressure

It is known that when the air temperature rises or the atmospheric pressure drops, the reduction in density of the air brings about enrichment of the mixture introduced into the engine.

SUMMARY OF THE INVENTION

It is an object of the invention to provide a carburettor in which the fuel/air mixture is controlled in accordance with at least one of the various operating parameters of the engine listed above.

The invention provides a carburettor for an internal combustion engine which includes a valved air inlet, a main duct and an auxiliary duct leading from said inlet, each of said ducts including a main valve for controlling the flow of air therethrough, a fuel supply tube for supplying fuel into the auxiliary duct upstream of the main valve in the auxiliary duct, means for mixing the fluid leaving said ducts to form a fuel/air mixture to be delivered to the engine, an auxiliary valve in the auxiliary duct upstream of said tube, sensing means responsive to at least one engine parameter selected from the group comprising engine temperature, temperature of said fuel/air mixture, atmospheric pressure, pressure drop across an air filter connected to said inlet, degree of combustion of the fuel/air mixture in the engine, and rate of recycling of combustion gases into the fuel/air mixture, and operative means responsive to said sensing means for operating said auxiliary valve for altering the ratio of fuel to air in said mixture in accordance with said at least one of the engine parameters.

BRIEF DESCRIPTION OF DRAWINGS

In order that the invention may be more fully understood a preferred embodiment thereof will now be described with reference to the accompanying drawings in which.

DESCRIPTION OF A PREFERRED EMBODIMENT

Figure 1:
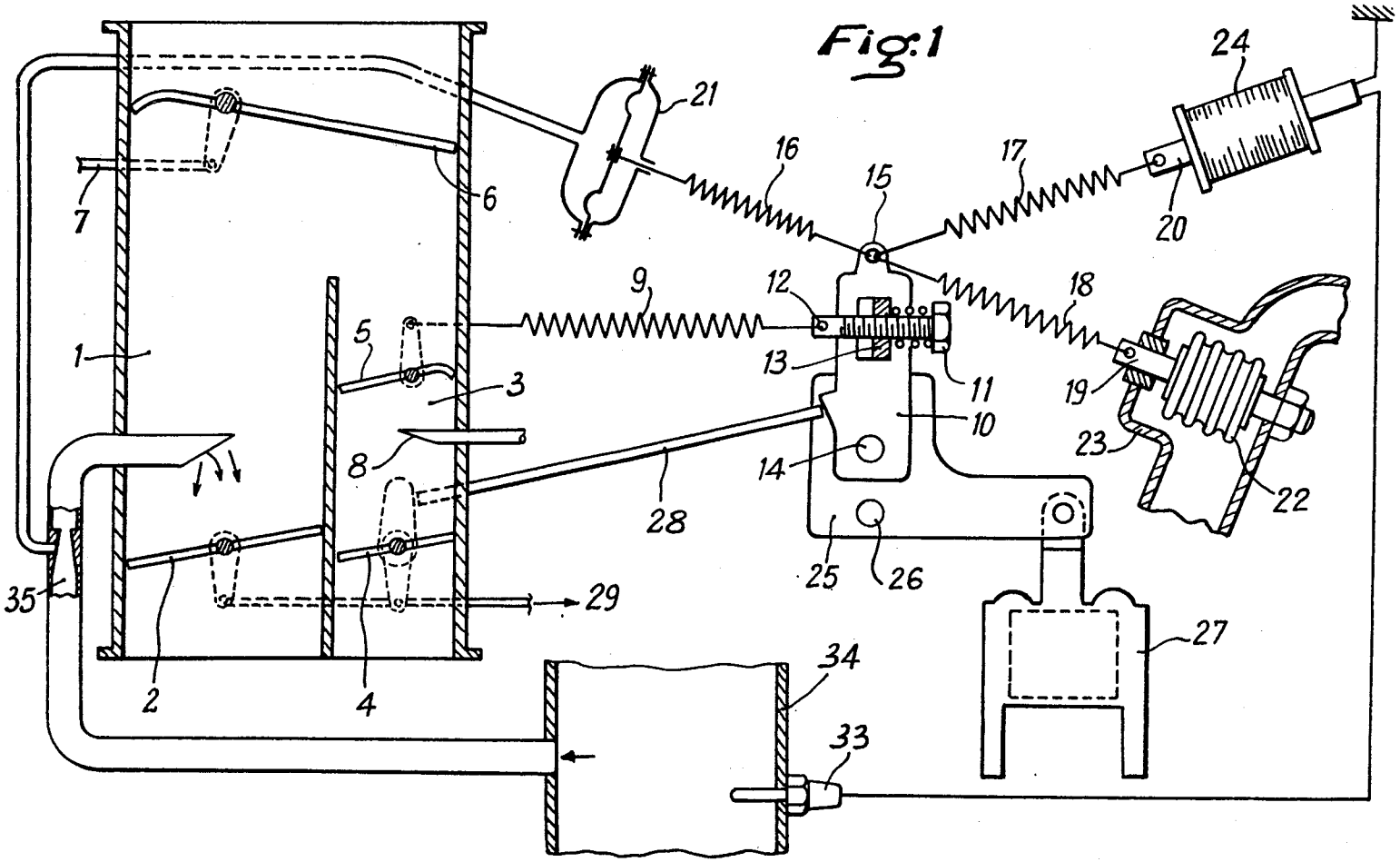
FIG. 1 is a schematic view, partially in section of a carburettor in accordance with the invention.

Referring to FIG. 1, the carburettor has an inlet from which extends a main duct 1 containing a main butterfly valve 2, and an auxiliary duct 3 containing a main butterfly valve 4. A supplementary automatic valve 6 is disposed upstream of the main valves, the automatic valve 6 controlling a fuel-proportioning needle valve (not shown) by means of a transmission shaft 7. A fuel inlet tube 8 is situated in the auxiliary duct and receives fuel from the needle. An auxiliary valve 5 is provided in the auxiliary duct which comprises an eccentric butterfly-valve returned by a spring 9. The construction and operation of the elements described above is known and described in our aforementioned U.S. patent.

The end 12 of the spring 9 is fixed in an adjustable position on to the arm 10 by means of a screw 11 cooperating with a nut 13 which is integral with the arm 10.

The idling speed mixture is adjustable by means of the screw 11 as will be apparent from our aforementioned U.S. patent. The arm 10 is hinged at one end 14 and connected at its other end 15 by springs 16, 17, 18 to movable members 19, 20, 21.

Member 19 comprises the movable end of an aneroid capsule 22 located in the intake manifold of the engine between the carburettor and the air filter and preferably at the outlet from the air filter. Thus a reduction in atmospheric pressure or an increase in the pressure drop across the air filter acting on the capsule 22 tends to reduce the tension of the spring 19 and hence of the spring 9 and enables the butterfly valve 5 to open and hence reduce the pressure gradient along the auxiliary duct and thereby weaken the fuel/air mixture.

A temperature sensitive element may also be included in the inlet manifold and connected to the lever 10 in a similar manner.

The member 20 is the core of an electromagnet 24 which is subjected to the variable voltage from a probe sensitive to variations in the composition of the exhaust gases from the engine. In this example of the invention, an oxygen probe 33 is located in an exhaust pipe 34 and detects the level of oxygen in the gases. The probe 33 permits an electrical signal indicative of the sensed oxygen level to be applied to the electromagnet 24, and thus the plunger 20 is moved to control the tension in springs 9, 17 and alter the setting of the butterfly valve 5. Thus the fuel/air mixture is controlled in accordance with pollutants in the exhaust gases so as to reduce the pollutants.

As shown in FIG. 1, exhaust gases from pipe 34 are recirculated into the carburettor so as to reduce nitrogen oxides in the exhaust gases, the gases being drawn in to the carburettor by means of a venturi tube.

An aneroid capsule 21 is provided having a diaphragm responsive to the reduced pressure in the venturi tube so as to provide an indication of the recirculation rate of exhaust gas. A conduit leads from the capsule 21 to a venturi pressure measuring system 35 located in the exhaust gas recirculation tube. Thus the tension in springs 16 and 9 is a function of the recirculation rate of exhaust gas, such that if the recirculation rate changes, the butterfly valve 5 alters the fuel/air mixture to maintain an optimum proportion of fuel in the gas mixture entering the engine.

The hinge 14 is mounted on a lever pivoting at 26 about a fixed point and in turn acted upon by a means 27, for example, a means responding to the temperature of the engine cooling water, such as a bimetallic strip or an expansible wax capsule.

It has been found difficult with the carburettor described above to control the fuel/air mixture at engine idling speeds, but the butterfly valve 5 permits the mixture to be enriched by action at idling speeds. At idling speeds the butterfly valves 2 and 4 are closed by means of rod 29 attached to an accelerator pedal, and when closed a cam attached to valve 4, pushes a rod 28 against a flat on the arm 10 so as to push back arm 10 and enrich the mixture when the engine is idling.

While the auxiliary valve has been described above in the form of an eccentric butterfly valve, other valves such as flap valves, pistons, etc. may be employed and fitted to the carburettor.

Figure 2:
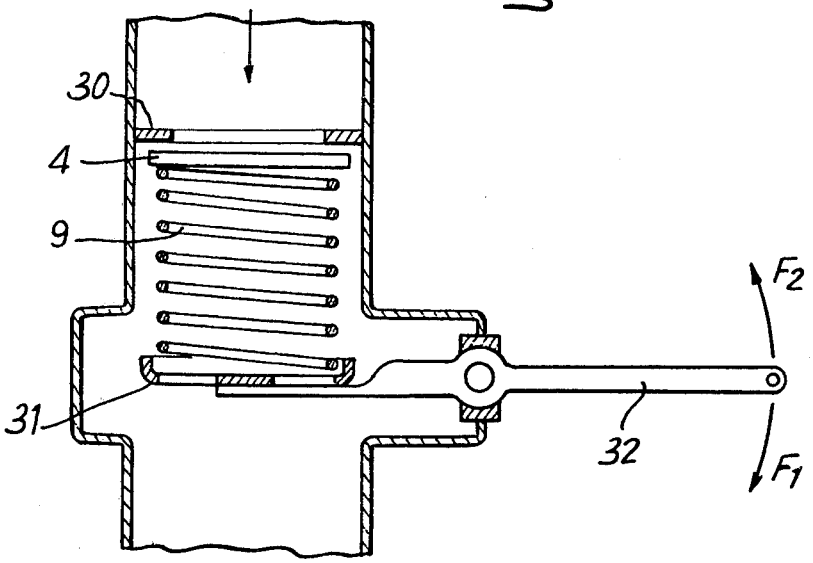
FIGS. 2 and 3 are views in section of further embodiments of an auxiliary valve for use in the carburettor.
Figure 3:
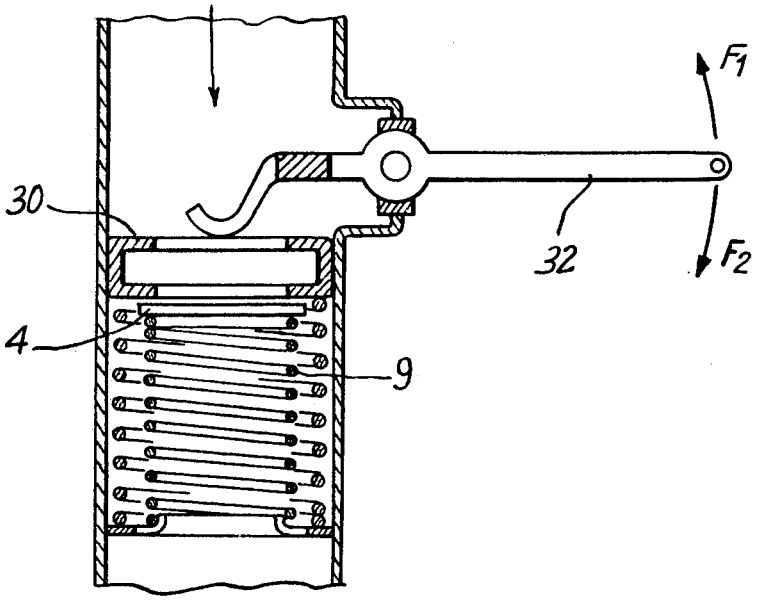

Two other embodiments of the auxiliary valve are shown in FIGS. 2 and 3 in which a valve member 5 is movable to and from its seating 30 by a spring 9 supported at 31, the distance between the valve member and the seat being controlled by a lever 32. The lever 32 is subjected to the action of the various parameters selected, as illustrated in FIG. 1. Thus the arrow $F_1$ corresponds with fuel enrichment of the fuel/air mixture and the arrow $F_2$ with weakening of the mixture.

We claim:

1. In combination a carburettor and internal combustion engine which has an inlet for a combustible fuel/air mixture and an outlet for combustion gases produced from said mixture, the carburettor comprising a body having an air inlet, a main duct and an auxiliary duct leading from said inlet, each of said ducts including a main valve for controlling the flow of air therethrough, a fuel supply tube for supplying fuel into said auxiliary duct upstream of the main valve in the auxiliary duct, a further valve in said inlet upstream of both said ducts for controlling the supply of air into said ducts, means for mixing the fluid leaving said ducts to form a fuel/air mixture to be applied to the inlet of the engine, an auxiliary valve positioned in said auxiliary inlet upstream of said fuel supply tube, sensing means responsive to the degree of combustion of the combustion gases from the outlet of the engine, and operative means responsive to the sensing means for operating said auxiliary valve for altering the ratio of fuel to air in said fuel/air mixture so as to maximize said degree of combustion.

2. A carburettor and an internal combustion engine according to claim 1 including a probe for producing an electrical signal indicative of the level of oxygen in said combustion gases, and a solenoid having a core movable in response to said electrical signal.

3. A carburettor and an internal combustion engine according to claim 2 including a pivotally mounted arm, a spring connecting said arm to said auxiliary valve, said sensing means being arranged to rotate said arm to alter the tension in said spring so as to alter the position of said auxiliary valve.

4. A carburettor and an internal combustion engine according to claim 3 including a spring connecting said arm to the core of said solenoid.

* * * * *